US005285537A

United States Patent [19]

Hanks

[11] Patent Number: 5,285,537

[45] Date of Patent: Feb. 15, 1994

[54] SHOWER WATER RECYCLING APPARATUS

[76] Inventor: Frederick F. Hanks, 646 Elizabeth Dr., Arcata, Calif. 95521

[21] Appl. No.: 913,215

[22] Filed: Jul. 15, 1992

[51] Int. Cl.[5] ..... A47K 3/22

[52] U.S. Cl. ..... 4/597

[58] Field of Search ..... 4/546, 559, 602, 603, 4/605, 665, 597

[56] References Cited

U.S. PATENT DOCUMENTS 4,224,700 9/1980 Bloys ..... 4/603
4,242,201 12/1980 Stephens et al. ..... 4/605 X
4,554,688 11/1985 Puccerella ..... 4/605 X

FOREIGN PATENT DOCUMENTS 2432292 4/1980 France ..... 4/602
2459643 2/1981 France ..... 4/597
2565811 12/1985 France ..... 4/597

*Primary Examiner*—Charles E. Phillips
*Attorney, Agent, or Firm*—Leon Gilden

[57] ABSTRACT

An apparatus including a pickup head mounted to a shower stall floor and selectively over the drain thereof is operative through a storage tank assembly to direct fluid from the shower stall floor into the storage tank for subsequent pressurized flow to an auxiliary shower head by way of an auxiliary shower head conduit to permit the recycling, heating, and filtering of water directed to the shower stall floor.

5 Claims, 5 Drawing Sheets

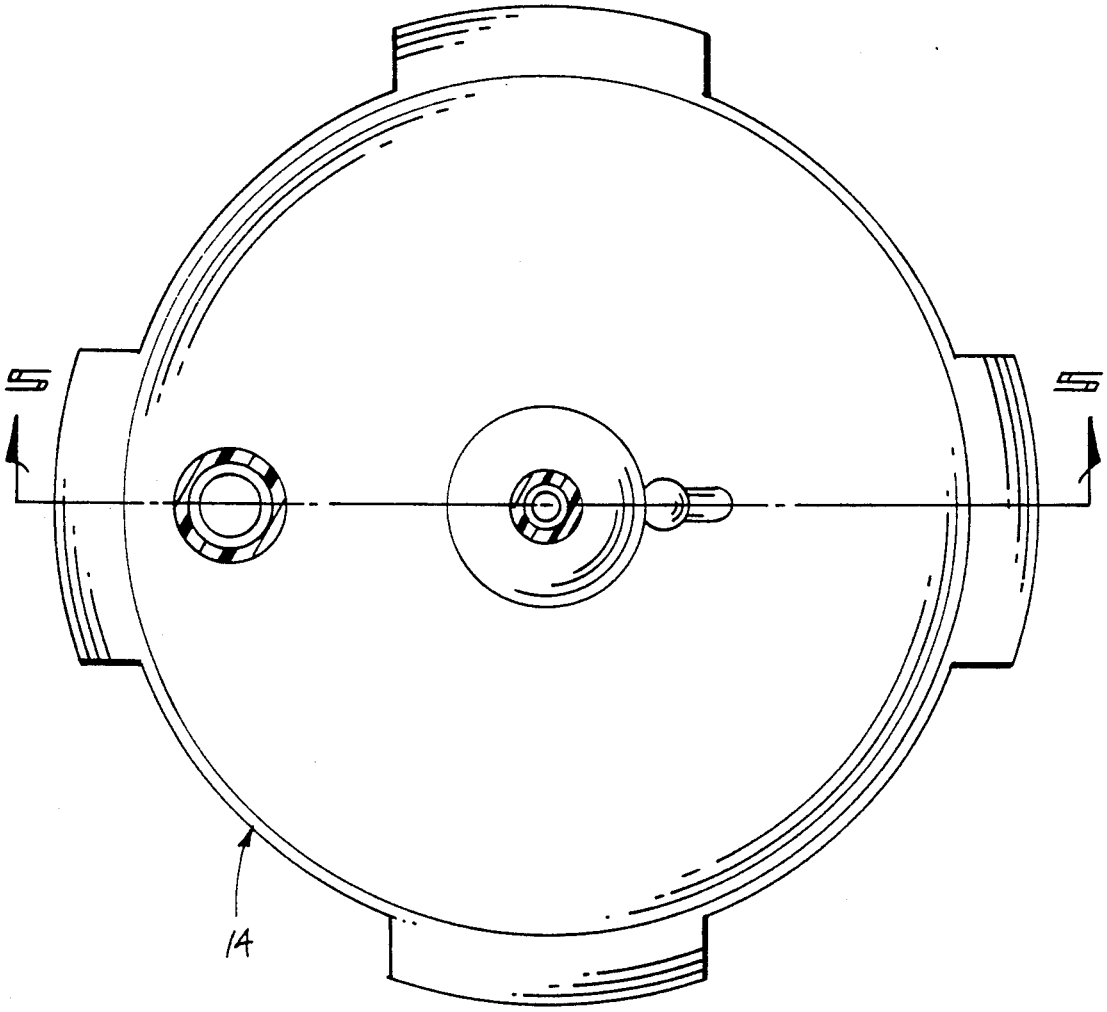
Fig 4
Fig 5
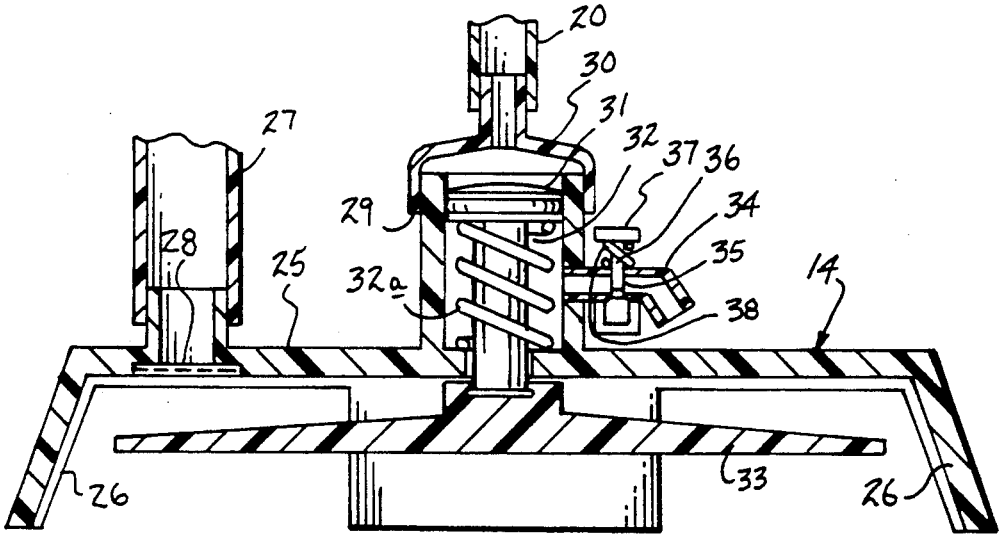

SHOWER WATER RECYCLING APPARATUS

BACKGROUND OF THE INVENTION

1. Field of the Invention

The field of invention relates to water recycling apparatus, and more particularly pertains to a new and improved shower water recycling apparatus wherein the same is directed to recycle shower water normally wasted through a shower stall floor and drain.

2. Description of the Prior Art

Prior art shower water recycling apparatus has been available in the prior art and indicated by U.S. Pat. No. 4,893,364 for the permanent mounting of the recycling structure relative to an existing shower stall.

U.S. Pat. No. 3,646,618 to Johnson sets forth a recycling portable shower for campers and trailers utilizing a recycling pump mounted to the portable shower structure.

U.S. Pat. No. 4,828,709 to Houser, et al. sets forth a recirculating shower for providing for fixed plumbing to recycle shower water.

Accordingly, it may be appreciated that there continues to be a need for a new and improved shower water recycling apparatus as set forth by the instant invention which addresses both the problems of ease of use as well as effectiveness in construction not addressed in the prior art for providing for a portable shower stall recycling apparatus and in this respect, the present invention substantially fulfills this need.

SUMMARY OF THE INVENTION

In view of the foregoing disadvantages inherent in the known types of recycling apparatus now present in the prior art, the present invention provides a shower water recycling apparatus wherein the same is arranged for the portable mounting of recycling apparatus relative to an existing shower stall. As such, the general purpose of the present invention, which will be described subsequently in greater detail, is to provide a new and improved shower water recycling apparatus which has all the advantages of the prior art water recycling apparatus and none of the disadvantages.

To attain this, the present invention provides an apparatus including a pickup head mounted to a shower stall floor and selectively over the drain thereof operative through a storage tank assembly to direct fluid from the shower stall floor into the storage tank for subsequent pressurized flow to an auxiliary shower head by way of an auxiliary shower head conduit to permit the recycling, heating, and filtering of water directed to the shower stall floor.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved shower water recycling apparatus which has all the advantages of the prior art water recycling apparatus and none of the disadvantages.

It is another object of the present invention to provide a new and improved shower water recycling apparatus which may be easily and efficiently manufactured and marketed.

It is a further object of the present invention to provide a new and improved shower water recycling apparatus which is of a durable and reliable construction.

An even further object of the present invention is to provide a new and improved shower water recycling apparatus which is susceptible of a low cost of manufacture with regard to both materials and labor, and which accordingly is then susceptible of low prices of sale to the consuming public, thereby making such shower water recycling apparatus economically available to the buying public.

Still yet another object of the present invention is to provide a new and improved shower water recycling apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is an orthographic top view of the pickup head utilized by the invention.

FIG. 6 is an isometric illustration of the storage tank assembly utilized by the invention.

DESCRIPTION OF THE PREFERRED EMBODIMENT

Figure 1:
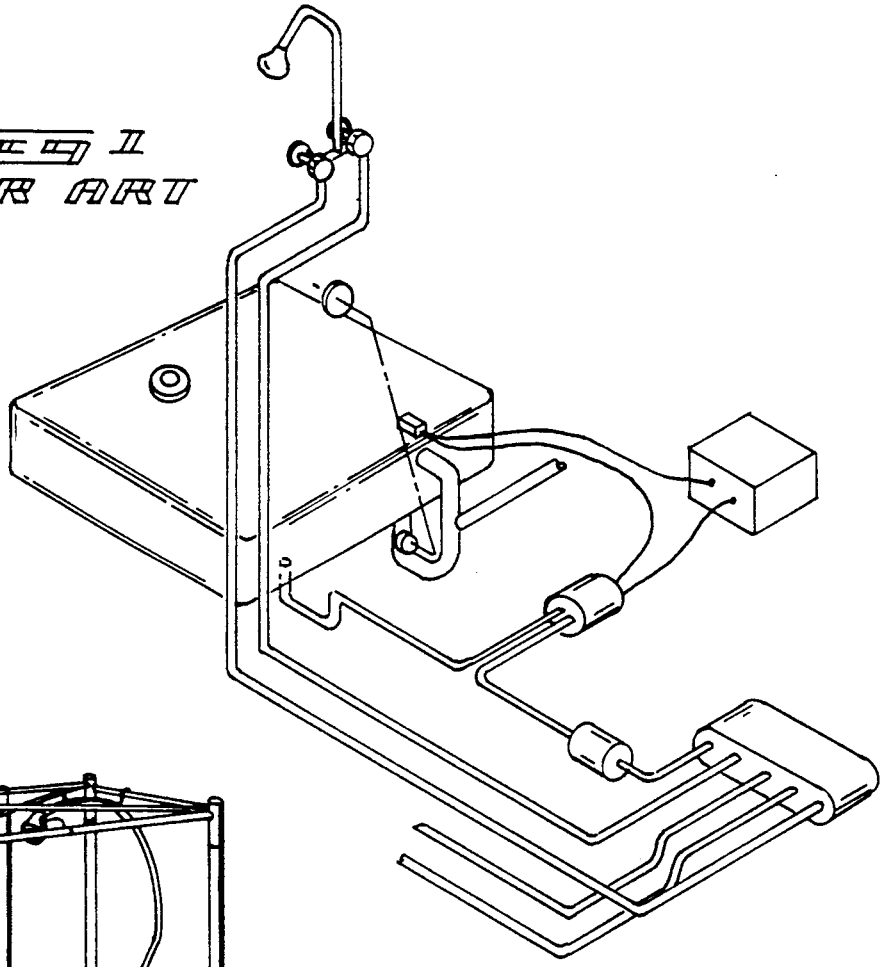
Fig 1 PRIOR ART
FIG. 1 is an isometric illustration of a prior art fixed plumbing recycling apparatus as set forth in U.S. Pat. No. 4,893,364.
Figure 2:
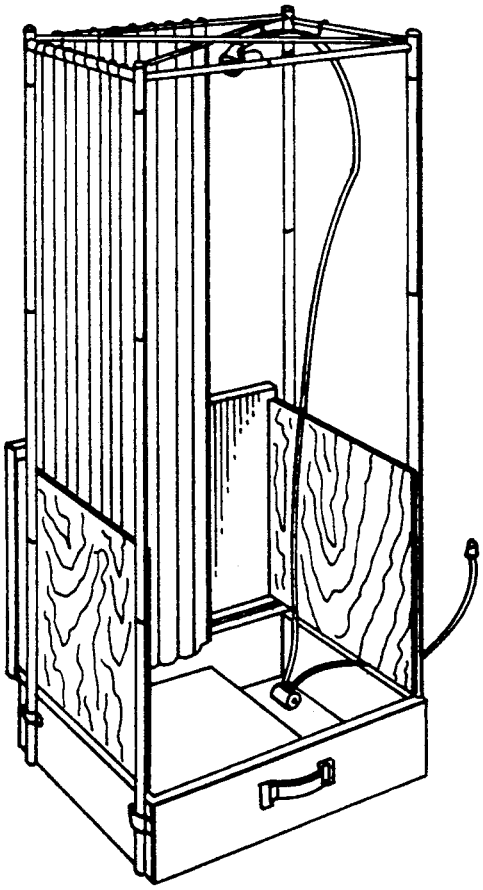
Fig 2 PRIOR ART
FIG. 2 is an isometric prior art illustration of a portable shower as set forth in U.S. Pat. No. 3,646,618 indicating a recirculating pump associated therewith.

With reference now to the drawings, and in particular to FIGS. 3 to 7 thereof, a new and improved shower water recycling apparatus embodying the principles and concepts of the present invention and generally designated by the reference numeral 10 will be described.

More specifically, the shower water recycling apparatus 10 of the instant invention essentially comprises mounting within a shower stall 11 having a shower stall floor 12 and a floor drain 13. A pickup head body 14 is in fluid communication with a storage tank assembly 15 and an auxiliary shower head 16. The auxiliary shower head 16 is mounted relative to a shower stall fluid conduit 17 having a fluid conduit shower head 18 mounted at a distal end thereof. A flow control valve 19 is mounted within a by-pass conduit 20 in fluid communication with the shower stall fluid conduit 17, with the by-pass conduit 20 directed through a check valve 21 into the pickup head 14.

Figure 7:
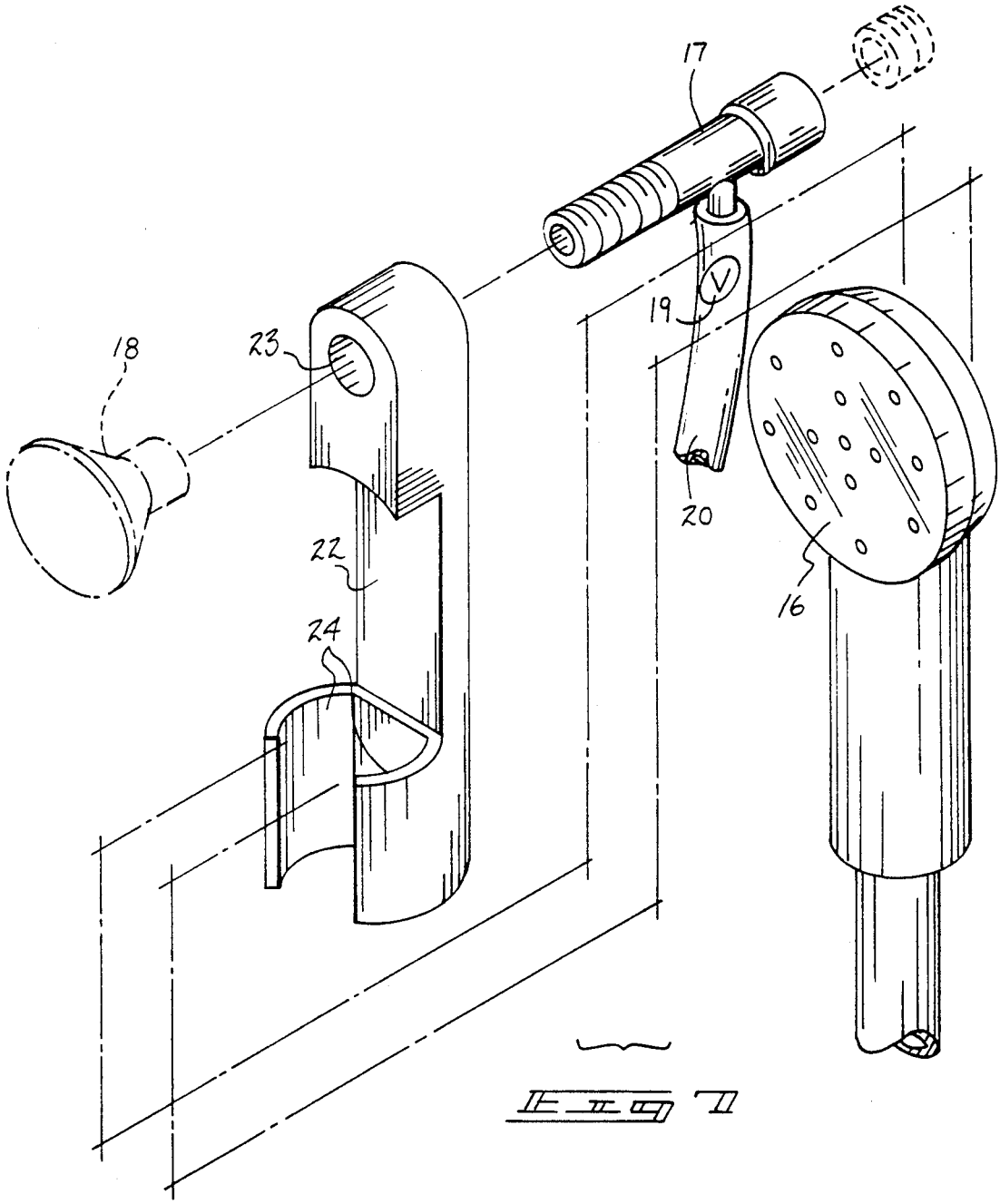
FIG. 7 is an isometric exploded illustration of the auxiliary shower head arranged for mounting relative to the existing shower stall plumbing.

With reference to the FIG. 7, a support hanger 22 is provided formed with a support hanger bore 23 receiving the shower stall fluid conduit 17 therethrough to position the hanger relative to and within the shower stall 11. Support hanger legs 24 are spaced apart to receive and position the auxiliary shower head 16 between the support hanger bore 23 and the support legs 24.

Figure 5:
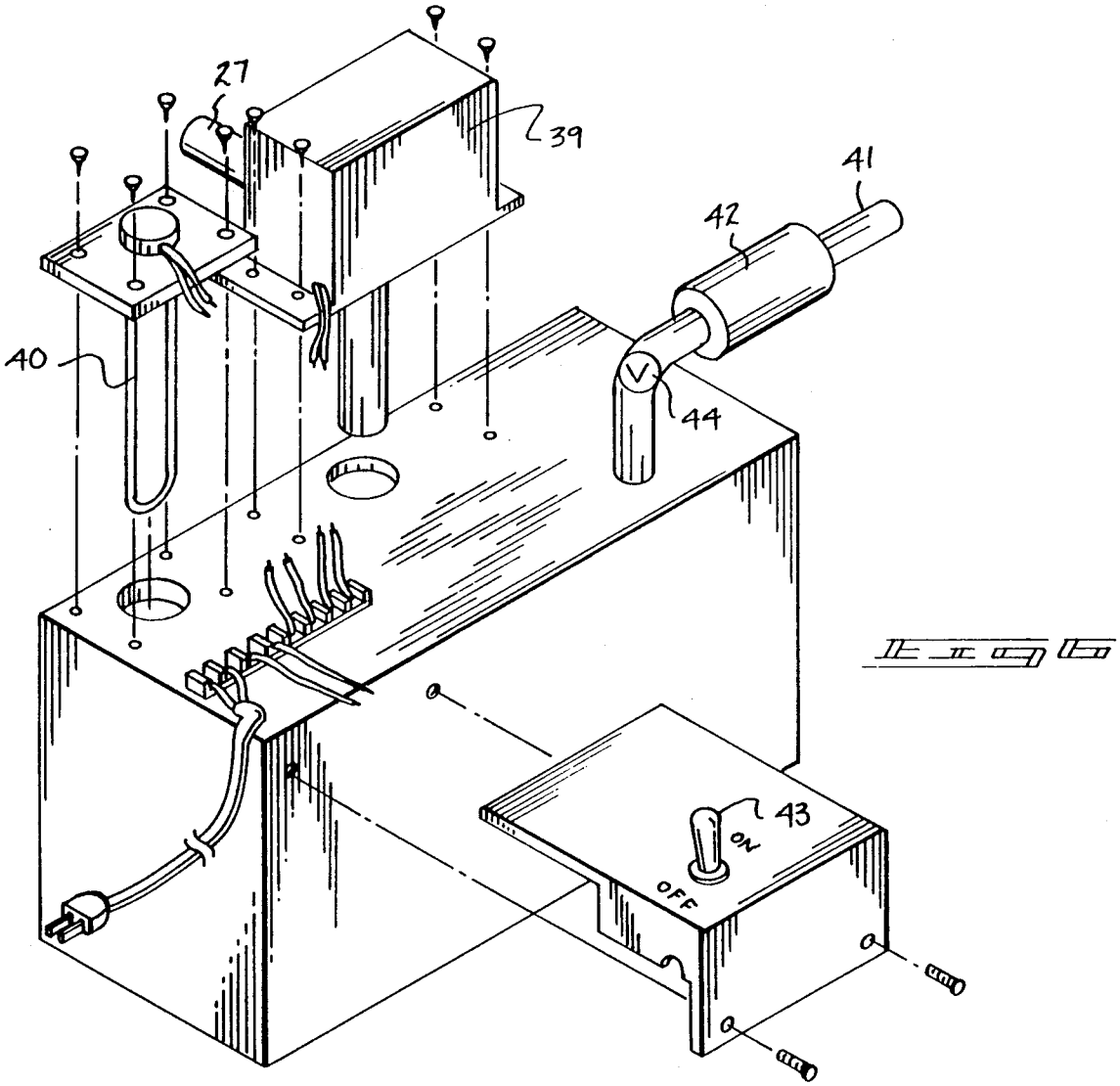
FIG. 5 is an orthographic view, taken along the lines 5-5 of FIG. 4 in the direction indicated by the arrows.

The pickup head 14 is formed with a pickup head flange 25 arranged for positioning in a spaced relationship relative to the floor drain 13 positioning the floor drain below the pickup head flange 25 and within flange legs 26 projecting downwardly relative to the flange arranged to position the drain between the flange and the legs 25 and 26 respectively. An inlet hose 27 is in fluid communication with the pickup head through the flange 25 having an inlet hose screen 28 removably mounted within the flange to control debris directed into the inlet hose 27. A central boss 29 having a central boss chamber 30 is coaxially and fixedly mounted to a top surface of the flange, with a chamber piston 31 slidably mounted within the chamber 30. The piston 31 includes a piston rod 32 orthogonally and slidably directed through the flange 25 capturing a piston rod spring **32*a*, including the piston 31 and the flange 25 within the chamber 30 to maintain the piston 31 in a raised orientation, as illustrated in FIG. 5. A flexible stopper plug 33 is mounted to a lower distal end of the piston rod 32 below the flange 25, whereupon fluid directed into the shower stall fluid conduit 17 is directed through the flow control valve 19 into the by-pass conduit 20 to pressurize the piston 31 against action of the piston rod spring 32*a* to depress the piston and piston rod within the chamber 30 and project the flexible stopper plug 33 onto an underlying drain to effect plugging of the drain during use of the organization. To release the flexible stopper plug 33 relative to the drain within the shower stall floor 12, a vent conduit 34 is directed into the chamber 30 having a valve rod 35 reciprocatably mounted through the vent conduit 34. The valve rod 35 includes a valve rod conduit 36 oriented above the vent conduit 34 in a first position and projected into the vent conduit 34 in a second position upon depressing the valve rod against cooperation of a valve rod spring 38 captured between a valve rod head 37 at an upper distal end of the valve rod, wherein the valve rod spring 38 is captured between the valve rod head 37 and the vent conduit 34**, as illustrated in FIG. 5.

Figure 3:
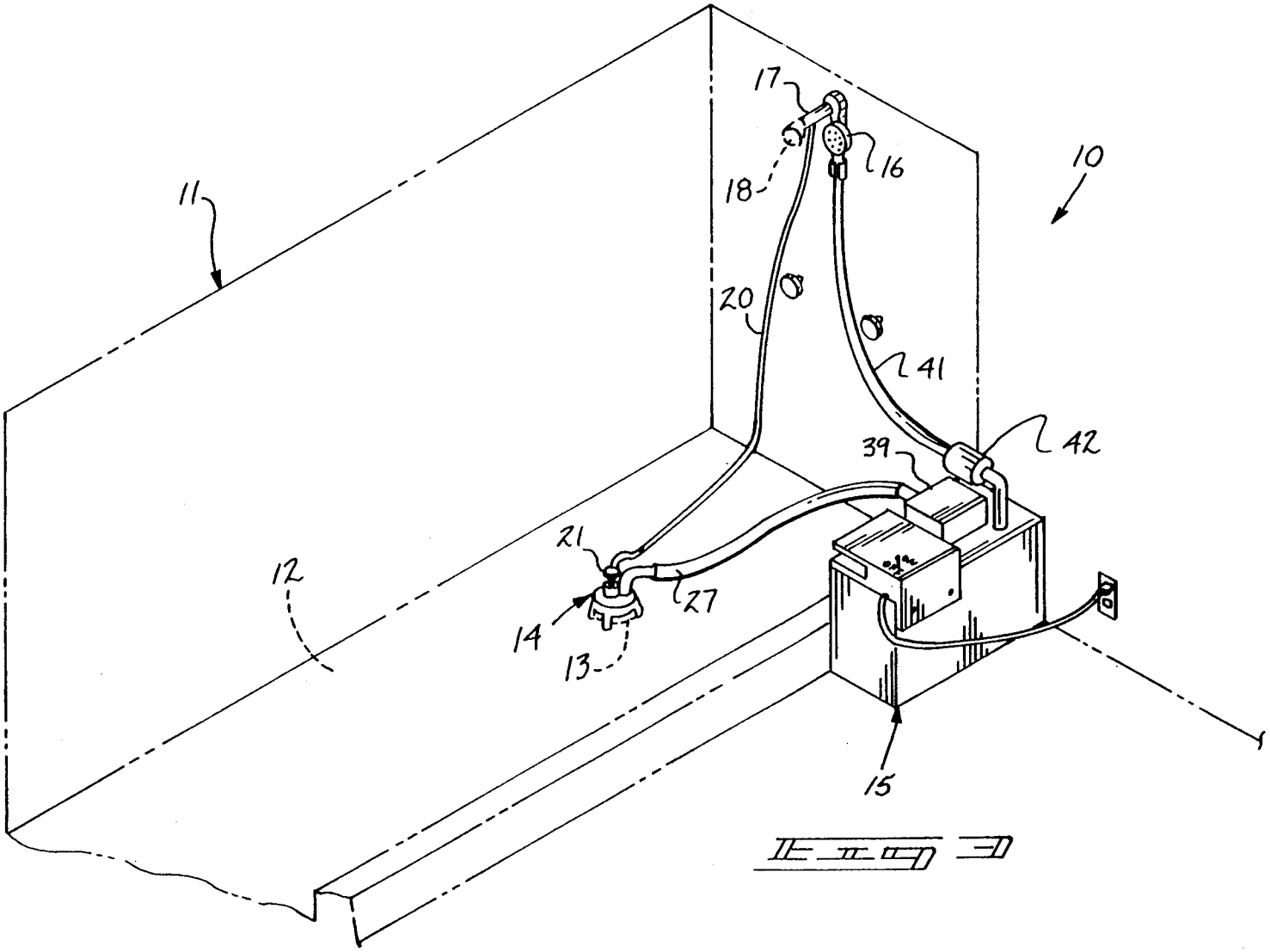
FIG. 3 is an isometric illustration of the instant invention.

The storage tank assembly 15, as illustrated in the FIGS. 3 and 6, includes a fluid chamber therewithin receiving fluid from the inlet hose 27 by means of a fluid pump 39 mounted to the storage tank assembly 15. An electrical resistance heater rod 40 is positioned within the storage tank for heating of fluid received from the shower stall. An auxiliary shower head conduit 41 is directed from the storage tank 15 permitting fluid flow therefrom upon opening of an outlet valve 44 to permit fluid flow to the auxiliary shower head 16 by way of a filter 42 that is replaceable to permit periodic maintenance of the filter during use of the organization. An on/off switch 43 is provided to provide electrical energy to simultaneously actuate the electrical resistance heater rod 40, as well as the fluid pump 39, during use.

It should be further noted therefore that the storage tank assembly 15 is permitted to fill if desired permitting subsequent heating of the water contained therewithin utilizing the pump 39 in a subsequent manner to direct the thusly heated fluid through the auxiliary shower head conduit 41 to the auxiliary shower head 16 that may be utilized to utilize the thusly preserved water within the storage tank assembly 15.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A shower water recycling apparatus in cooperation with a shower stall, having a floor and a floor drain, the shower stall further including a shower stall fluid conduit having a fluid conduit shower head, the apparatus further comprises, a pickup head mounted on the shower stall floor over the drain, and a storage tank assembly positioned exteriorly of the shower stall and being in fluid communication with the pickup head, and an auxiliary shower head positioned within the shower stall and being in fluid communication with the storage tank assembly, and a by-pass conduit is in fluid communication at one end with the shower stall fluid conduit, the by-pass conduit having a flow control valve mounted therewithin adjacent the shower stall fluid conduit, and the by-pass conduit in fluid communication at the other end with the pick-up head via a check valve, and the pickup head includes a pickup head flange, and a plurality of pickup head flange legs mounted peripherally about the pickup head flange projecting below the pickup head flange in surrounding relationship relative to the drain, and a central boss fixedly and coaxially aligned relative to the pickup head flange and projecting upwardly from the pickup head flange, with the central boss having a chamber and the by-pass conduit directed into the central boss directing fluid into the chamber through the check valve from the flow control valve, and a piston slidably mounted within the chamber, and a piston rod mounted to the piston, the piston rod coaxially aligned with the chamber, with the piston rod directed through the pickup head flange, and a flexible stopper plug mounted to a lower distal end of the piston rod below the pickup head flange above the drain, and a spring wound about the piston rod captured between the pickup head flange and the piston within the chamber.

2. An apparatus as set forth in claim 1 including an inlet hose directed through the pickup head flange mounted to the pickup head flange, with the inlet hose directed from the pickup head flange in fluid communication with the storage tank assembly, wherein the storage tank assembly includes a pump, with the inlet hose directed to the pump and the pump directed interiorly of the storage tank assembly to direct fluid therewithin.

3. An apparatus as set forth in claim 2 including a vent conduit directed into the central boss, with the vent conduit including a valve rod reciprocatably mounted within the vent conduit, the valve rod including a valve rod conduit, and the valve rod conduit positioned above the vent conduit in a first position and projected within the vent conduit in a second position, and wherein the valve rod includes a valve rod head spaced above the vent conduit, and a valve rod spring, wherein the valve rod spring is captured between the valve rod head and the vent conduit to bias the valve rod conduit to the first position permitting manual displacement of the valve rod to the second position.

4. An apparatus as set forth in claim 3 wherein the storage tank assembly further includes an electrical resistance heater rod directed into the storage tank assembly, and an on/off switch arranged for simultaneous actuation of the pump and the electrical resistance heater rod, and an auxiliary shower head conduit in fluid communication with the storage tank assembly directed from the storage tank assembly to the auxiliary shower head, with a filter mounted within the auxiliary shower head conduit, and an outlet valve mounted between the filter and the storage tank assembly to direct selective fluid flow through the auxiliary shower head conduit to the auxiliary shower head.

5. An apparatus as set forth in claim 4 including a support hanger, the support hanger having a support hanger bore receiving the shower stall fluid conduit therethrough, and the support hanger further including a plurality of support hanger legs positioned below the bore to receive the auxiliary shower head between the support hanger legs and the support hanger bore.

* * * * *